US005340268A

United States Patent [19]

Dowty

[11] Patent Number: 5,340,268

[45] Date of Patent: Aug. 23, 1994

[54] ARTICLE HANDLING MECHANISM FOR ATTACHMENT TO WAREHOUSE TRUCKS

[76] Inventor: Alvis E. Dowty, 4117 Renee, Jonesboro, Ark. 72401

[21] Appl. No.: 837,947

[22] Filed: Feb. 20, 1992

[51] Int. Cl.[5] ..... B66F 9/12

[52] U.S. Cl. ..... 414/622; 414/608

[58] Field of Search ..... 414/607, 608, 622, 623, 414/661, 662, 663; 211/23, 24, 49.1, 175, 195, 201, 208

[56] References Cited

U.S. PATENT DOCUMENTS

| | | | |
|---|---|---|---|
| 2,656,062 | 10/1953 | Thomas | 414/622 X |
| 3,773,202 | 11/1973 | Dutra, Jr. | 414/622 |
| 3,788,507 | 1/1974 | Voss | 414/607 |
| 3,809,264 | 5/1974 | Mayers | 414/608 X |
| 3,885,692 | 5/1975 | Anderson, Jr. | 214/514 |
| 4,116,349 | 9/1978 | Durham | 214/654 |
| 4,249,843 | 2/1981 | Kerr | 414/44 |
| 4,354,795 | 10/1982 | Dutra, Jr. | 414/622 |
| 4,549,845 | 10/1985 | Ramsey, Jr. | 414/622 X |
| 4,579,501 | 4/1986 | Fox | 414/622 X |
| 4,777,781 | 11/1988 | Doster et al. | 53/527 |
| 4,789,295 | 12/1988 | Boucher, Jr. et al. | 414/607 X |

FOREIGN PATENT DOCUMENTS

| | | | |
|---|---|---|---|
| 341436 | 11/1959 | Sweden | 414/622 |
| 1204556 | 1/1986 | U.S.S.R. | 414/622 |
| 1368259 | 1/1988 | U.S.S.R. | 414/622 |

*Primary Examiner*—Michael S. Huppert
*Assistant Examiner*—James T. Eller, Jr.
*Attorney, Agent, or Firm*—Shlesinger, Arkwright & Garvey

[57] ABSTRACT

An article handling mechanism for attachment to warehouse trucks or the like includes an article loading platform, a frame secured to the loading platform forming a rack, a generally horizontal member which is movably mounted for vertical movement with respect to substantially perpendicular sides of the frame; and a horizontally movable ram which moves within the frame from front to rear for ejecting articles under compression. The horizontal member is movable toward the platform to compress articles loaded on the platform and is movable away from the platform to increase the loading area of the resultant rack.

17 Claims, 5 Drawing Sheets

ARTICLE HANDLING MECHANISM FOR ATTACHMENT TO WAREHOUSE TRUCKS

FIELD OF THE INVENTION

The present invention relates generally to a rack system for packing and shipping, in economical form, a plurality of articles and more particularly concerns a handling mechanism in which tires are stacked, compressed and then removed for compact storage within another container (e.g., a trucking trailer).

BACKGROUND OF THE INVENTION

A plurality of storage racks for automotive and vehicular pneumatic tires are available which display tires in their upright position. While an upright arrangement of tires provides random access to the plurality of tires stored thereon, the amount of space required to store tires in this manner is not economical for packing and shipping purposes. Accordingly, racks used for displaying articles or tires are not efficient for packing tires within a container, such as a trailer, for shipment and distributing manufactured articles or tires to retailers.

In addition, racks are known which store tires while stacked in their horizontal position or in the so-called stovepiped formation. Like other known tire display racks, racks for storing tires horizontally can be stacked on top of one another to increase the number of tires stored on a floor area. However, this upward extension of stored tires is limited by the height of the room or container and the size of the stackable rack.

Article handling mechanisms are known which can be attached to a standard forklift or warehouse truck. However, these conventional handling mechanisms are not suitable for compressing stacked articles and/or ejecting the compressed, stacked articles for compact storage in a shipping container or the like.

U.S. Pat. Nos. 4,116,349 to Durham and 4,354,795 to Dutra, Jr. disclose load stabilizing devices with a horizontally extending webbed member or plate mounted for vertical movement above the fork tines of a warehouse truck. Neither device includes a loading platform on which articles can be positioned or means for ejecting the positioned articles. Moreover, the disclosed stabilizing member or plate is merely a clamp and cannot compress the articles for compact storage A handling system for interlocking cover or folded cap cartons is described in U.S. Pat. No. 3,885,692 to Anderson, Jr. which basically consists of a horizontally adjustable, vertically oriented positioning plate and a hook like member. This positioning plate must be mounted on a specialized frame secured to the front end of a warehouse truck. Thus, this system only can be used for carrying boxes or the like on forklift tines. No stacking of articles or tires, let alone compression, can be achieved with this device.

The typical form employed for shipping tires is a rick, created by stacking alternate rows of tires within a shipping container. Each row of tires is placed at a substantially acute angle; and successive rows are placed at alternating angles, creating an interleaved and interlocking effect. While the number of resultant stacked tires is greater than that achieved by conventional upright or horizontal (stovepiped) stacking, the overall density of a tire shipment is still low in relation to the enclosed air space of a shipping container.

U.S. Pat. No. 4,777,781 to Doster et al. describes an apparatus for creating high density tire ricks in order to increase the number of tires shipped per container. However with Doster's apparatus, the tires must be stacked manually within a trailer or other shipping container and then, employing a specially constructed warehouse truck, vertically compressed to a volume approximately one-half of that ordinarily required. While the warehouse truck continues to hold the previously stacked tires down with a vertical wedge, workers stack additional tires above the wedge platform. After tires have been manually stacked to the roof of the container, the compressing wedge is removed and the resultant tire stacks can be compressed again, if desired. However, several disadvantages are associated with this apparatus.

In particular, individual tires must be handled continually throughout the packing process. First, workers stack a row of tires within the confines of a trailer or other shipping container, then the single-job dedicated warehouse truck compresses the initially stacked tires, and finally the workers stack additional tires individually on top of the compressed stacked tires. This process continues filling the container row by row until no more tires can be manually stacked therein.

Consequently, not only is Doster's apparatus an expensive investment, it limits stacking and compressing to a particular area within a container. As a result, workers are forced to perform the manual stacking inside a hot and sweaty container. Further, even with an efficient packing operation, the number of tires actually compressed thereby increasing packing density is limited since the final step includes manual packing and thus, tires which are not compressed. Thus, in effect, the amount of time required to pack a container with Doster's apparatus limits the increased density since approximately one-half of the tires are compressed. Moreover, the alternation of machine compressing and manual stacking is time consuming.

Therefore, it can be seen that there is a need for an article handling mechanism in which all of the articles or tires can be stacked and compressed outside the confines of a shipping container. In addition, there is a need for such a compression mechanism from which the stacked and compressed articles or tires can be easily displaced from the mechanism into a shipping container. With such construction, the articles or tires could be stacked in one location, compressed and then moved to another location for placement in a shipping container.

OBJECTS AND SUMMARY OF THE INVENTION

A principle object of the invention is to provide a mechanism for compressing stacked articles which includes a ram for pushing the compressed, stacked articles or tires into a shipping container or the like. An advantage of such a rack is that it eliminates the need to manually handle the articles individually two or three times during the packing process.

It is an associated object to provide a rack in which a plurality of articles or tires can be stacked and which includes means for simultaneously compressing all of the stacked tires and means for unloading, the stacked, compressed rows of tires onto a shipping container floor for compact storage. Such a device permits easy loading and increased density of tires to be shipped thereby reducing shipping costs.

A related object of the present invention is to provide a compression rack with a horizontally movable back wall which serves to push the stacked compressed articles from the mechanism into a container which maintains the articles under compression.

It is yet another object of the invention is to provide a tire compression rack with a ram that can be easily attached to a standard forklift or warehouse truck so that the rack and the articles compressed therein can be easily moved from one location of a warehouse to another, for example.

Similarly, it is an object of the invention is to provide means for reducing friction during extraction of the compressed tines from the mechanisms.

A further object of the above invention is that the rack includes an adjustable cover member which can compress articles or tires stacked therein up to 40% more than manually stacked tires.

More particularly stated, it is an object of the invention that the tire compression rack can stack and compress tires in both the stovepiped and ricked formations which results in significant cost savings in overall shipment cost of manufactured tires due to the increased volumetric efficient of the shipped rack.

Still another object of the invention is that the rack, itself, has hydraulic or pneumatic cylinders attached thereto for moving the movable back wall. Accordingly, the compression rack according to the invention is a complete unit and no additional structures are required.

In summary, a handling mechanism according to the invention includes a loading frame forming a rack, a plurality of spaced-apart upright sections associated with the loading frame, a cover section having a plurality of spaced-apart side legs in slidable communication with respective upright sections of the loading frame, means for automatically moving and locking the slidable side legs and upright sections together to vertically compress articles stacked within the rack, and ramming means for pushing the compressed stacked articles off the loading frame.

BRIEF DESCRIPTION OF THE DRAWINGS

Other objects, features and advantages of the invention and a better understanding of its construction and operation will be apparent from the following description, taken in conjunction with the accompanying drawings in which:

FIG. 6 is a side elevational view of the handling mechanism of FIG. 2 depicting the horizontal ramming motion for ejecting compressed, stacked tires into a shipping container or the like.

DESCRIPTION OF THE PREFERRED EMBODIMENT

Figure 1:
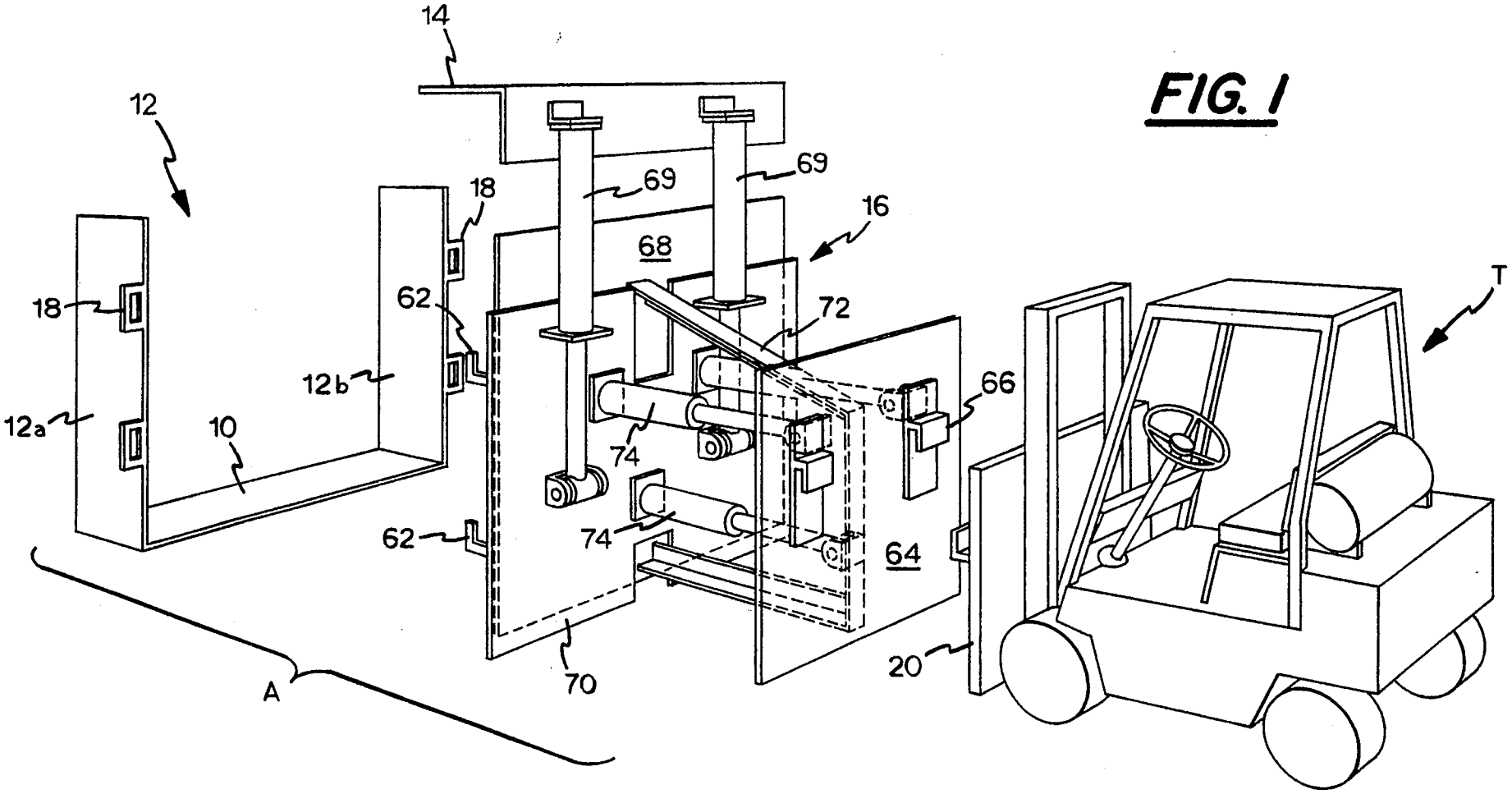
FIG. 1 is an exploded, perspective view of a handling mechanism according to the invention which includes a separate ramming unit.

Turning first to FIG. 1, there is shown an article handling mechanism A for attachment to warehouse trucks T or the like. While it is contemplated that other forms of truck attachment may be employed, the illustrative handling mechanism A is adapted to be supported by the connections means provided on a standard warehouse truck T for attaching a forklift attachment F (see FIGS. 2 and 4–6).

The general structure of an article handling mechanism A according to the invention includes an article loading platform 10, and a frame 12 secured to loading platform 10 forming a rack and including a pair of sides 12*a*, 12*b* which extend substantially perpendicular from respective sides of loading platform 10. A generally horizontal member 14 may be mounted for vertical movement with respect to sides 12*a*, 12*b* for compressing articles stacked within frame 12, and a horizontally movable ram 16 is adapted for connection with frame 12 for movement therein so that articles stacked on loading platform 10 can be ejected from frame 12.

Horizontal member 14, in effect, can serve as a cover member and is adapted for movement between sides 12*a*, 12*b* to compress articles loaded on platform 10 when moving toward platform 10. Additionally, horizontal member 14 can be moved away from platform 10 to increase the loading area of the rack formed by frame 12 and loading platform 10. Thus, in keeping with one of the principle objects of the invention, horizontally movable ram 16 can displace stacked articles which have been compressed by horizontal member 14 into a shipping container or the like for compact packing.

In the illustrated handling mechanism A, ram 16 is a separate unit which will be fully described below. As shown in FIG. 1, ram 16 is adapted for connection to handles 18 disposed on a front end of sides 12*a*, 12*b* and can be coupled to a warehouse truck T by employing the connection means 20 provided for attaching a forklift attachment F. Thus, in this embodiment, the standard forklift tines are removed.

Figure 6:
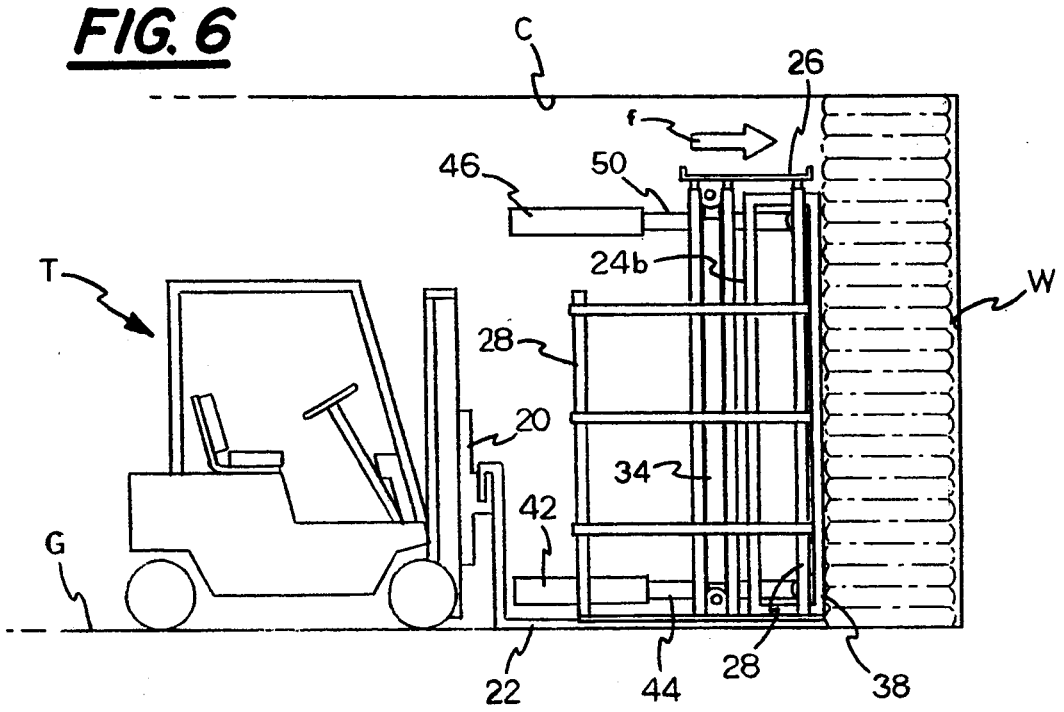
Figure 2:
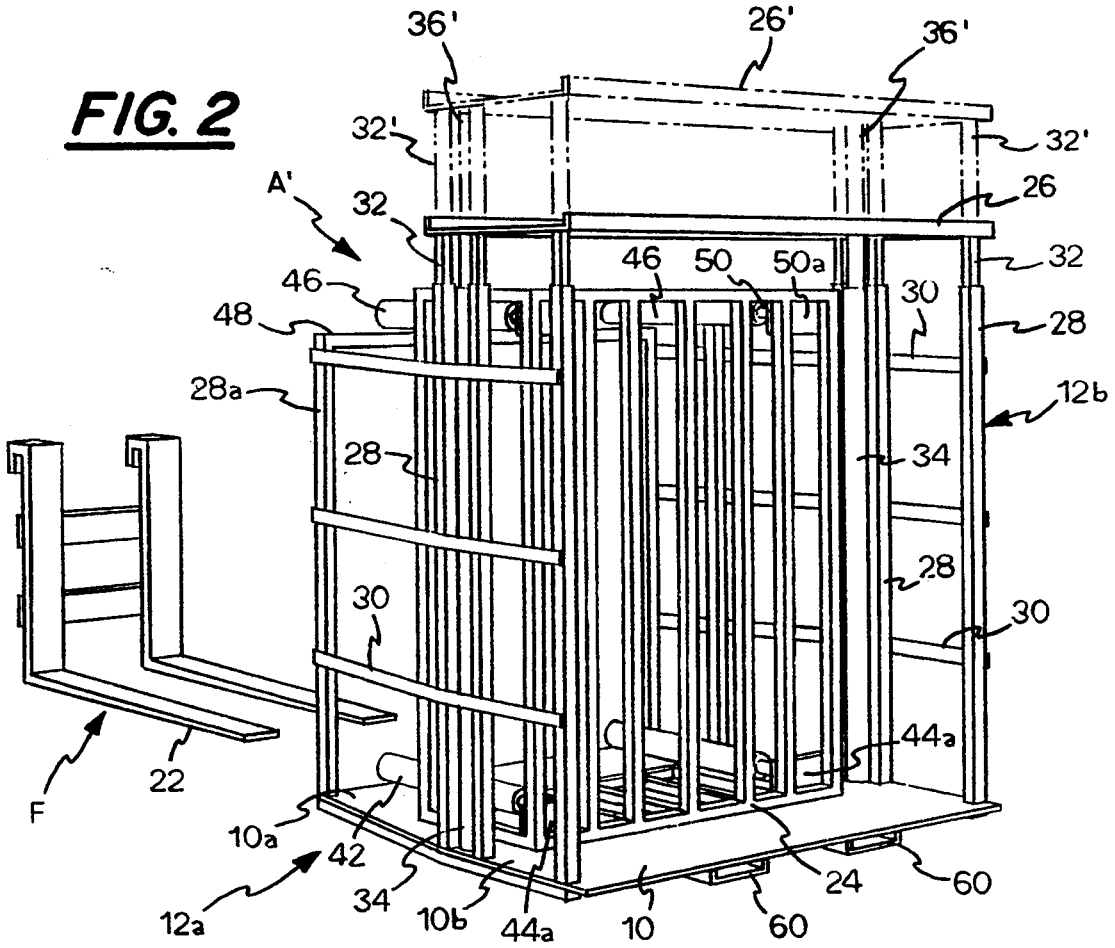
FIG. 2 is a perspective view of another handling mechanism according to the invention which forms a self-contained structure or rack.
Figure 4:
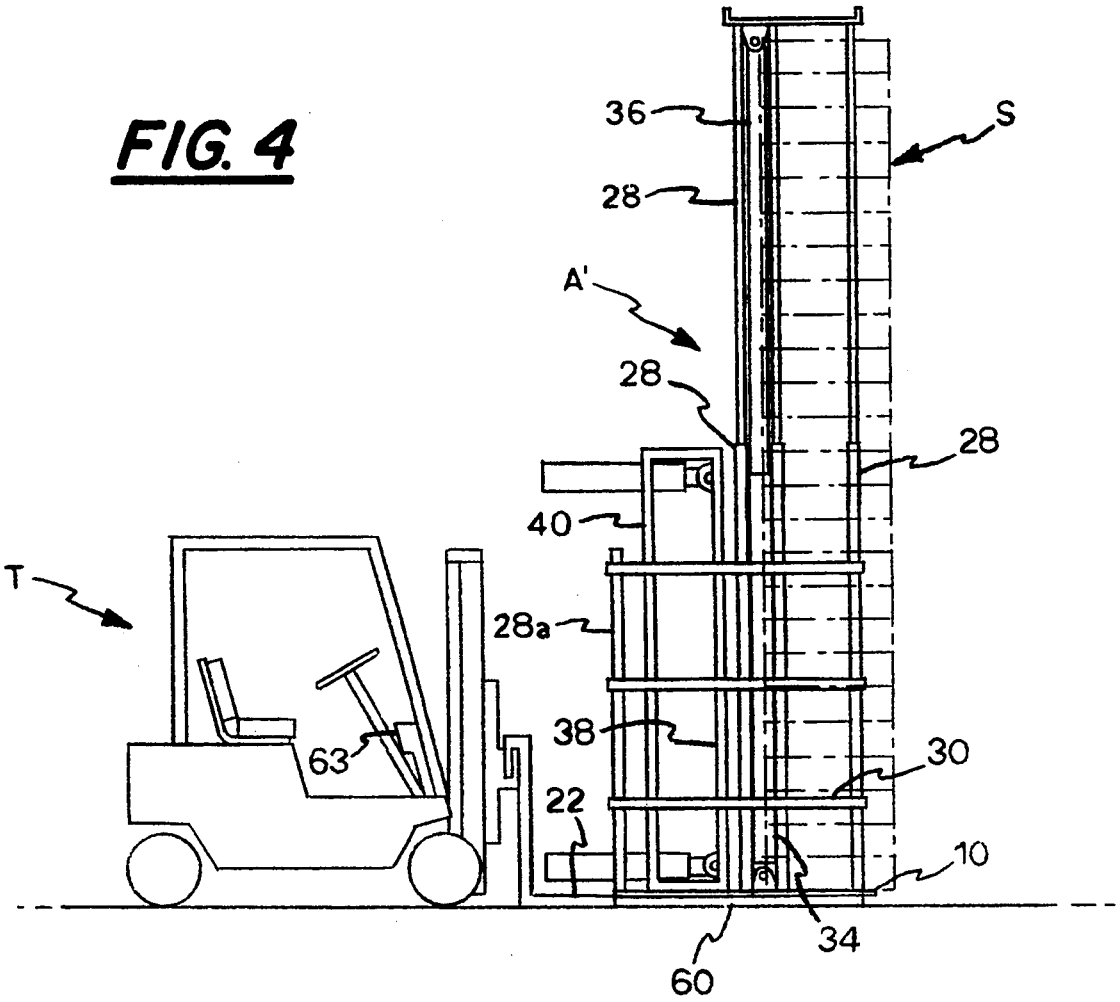
FIGS. 4 and 5 are side elevational views of the handling mechanism of FIG. 2 in engagement with forklift tines of a warehouse truck where phantom lines illustrate tires stacked in an initial loaded position and a compressed position, respectively.
Figure 5:
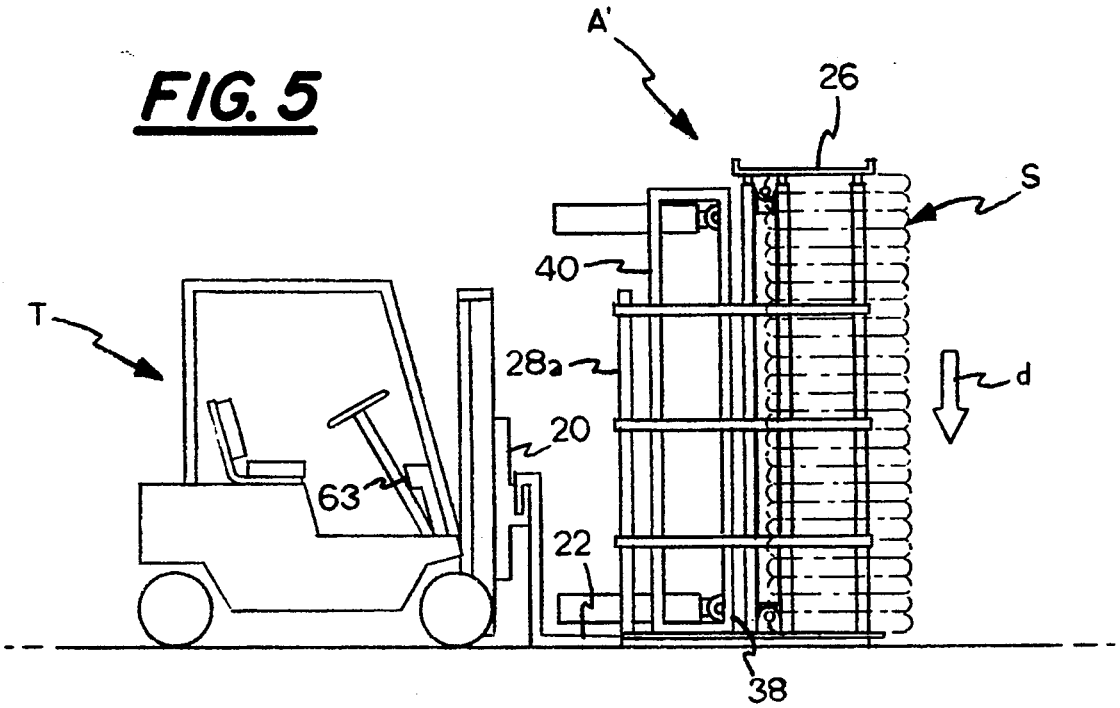

However, in a preferred embodiment as shown in FIG. 2, the article handling mechanism A′ is adapted to be supported by the tines 22 of a forklift attachment F coupled to a warehouse truck T as shown in FIGS. 4–6. Thus, an article handling mechanism according to the invention does not require a special attachment frame or a specialized warehouse vehicle for carrying the same about a warehouse.

Moreover, the article handling mechanism A′, itself, is a self-contained structure. Elements of handling mechanism A′ which are similar to those elements in handling mechanism A are given like reference numerals.

Referring to FIG. 2, frame sides 12*a*, 12*b* can serve as sidewalls of a generally, U-shaped rack formed with loading platform 10 and in which a plurality of articles or tires can be stacked. In addition, self-contained handling mechanism A′ includes a vertical wall 24 which is movably disposed between the pair of frame sidewalls 12*a*, 12*b* for movement in the horizontal direction, and an adjustable cover member 26 which is mounted for vertical movement with respect to frame sidewalls 12*a*, 12*b*. This height adjustability is illustrated in FIG. 2 by priming reference numerals designating raised elements which are shown in phantom.

In this embodiment, frame sidewalls 12a, 12b each may be constructed with a plurality of spaced-apart upright sections 28 which are linearly disposed on respective sides of loading platform 10 and a plurality of cross braces 30 which are secured across respective upright sections 28 to strengthen the resultant frame sidewall 12a, 12b. Cover member 26 may have a plurality of side legs 32 extending substantially perpendicular from cover member 26 and in slidable communication with corresponding upright sections 28. Preferably, upright sections 28a mounted on respective sides of a rear portion 10a of loading platform 10 and forming a corner of the resultant rack are not in slidable communication with side legs 32 of cover member 26.

Additionally, a pair of cylinders 34 can be vertically disposed along the line of upright sections 28 on respective sides of loading platform 10. Cylinder 34 can be mounted to loading platform 10, while its associated piston 36 can be secured to a side of cover member 26. Either a hydraulic or pneumatic cylinder actuation system can be employed to operate vertically disposed cylinders 34 for automatically moving and locking slidable legs 32 with respect to corresponding upright sections 28 for vertically compressing articles stacked within self-contained handling mechanism A'.

Preferably, upright sections 28 corresponding to side legs 32 are hollow and have a larger circumference or diameter than that of their corresponding side legs 32 to provide a telescopic, slidable communication. Moreover, in this embodiment, upright sections 28 in slidable communication with side legs 32 are positioned on a front portion 10b of loading platform 10 so that rear portion 10a of loading platform 10 can be rearwardly tapered providing an unobstructed angle of vision for an operator carrying a fully loaded rack.

Movable vertical wall 24 serves as a ramming device for pushing the compressed, stacked articles off loading platform 10, and should have a width slightly smaller than that of the resultant U-shaped rack so that vertical wall 24 can move easily in the horizontal direction. Likewise, movable wall may have a front wall 38 and a rear wall 40 (see FIGS. 4–6) which form a housing for valves or other structure necessary to operate a hydraulic or pneumatic system providing the horizontal movement. Preferably, front and rear walls 38, 40 have a plurality of spaced bars and are cage like in construction so than an operator can see through the resultant movable wall 24.

As shown in FIGS. 2–6, in a preferred embodiment, a pair of cylinders 42 can be mounted, via conventional means, on respective sides of rear portion 10a of loading platform 10 while their associated pistons 44 are coupled, via a mounting plate 44a or other conventional means, to respective bottom sides of front wall 38 of vertical wall 24 as shown in the Figures. Likewise, a second pair of cylinders 46 can be mounted, via conventional means, to a support bar 48 attached to corner upright sections 28a and extending across the top of the resultant U-shaped rack. The associated pistons 50 of cylinders 46 can be coupled, via mounting plate 50a or other conventional means, to respective top sides of front wall 38 of vertical wall 24. Thus, in this embodiment a piston and cylinder arrangement is employed at each one of the four corners of vertical wall 24 thereby providing a smooth ramming effect as vertical wall 24 impacts articles stacked within the rack.

Figure 3:
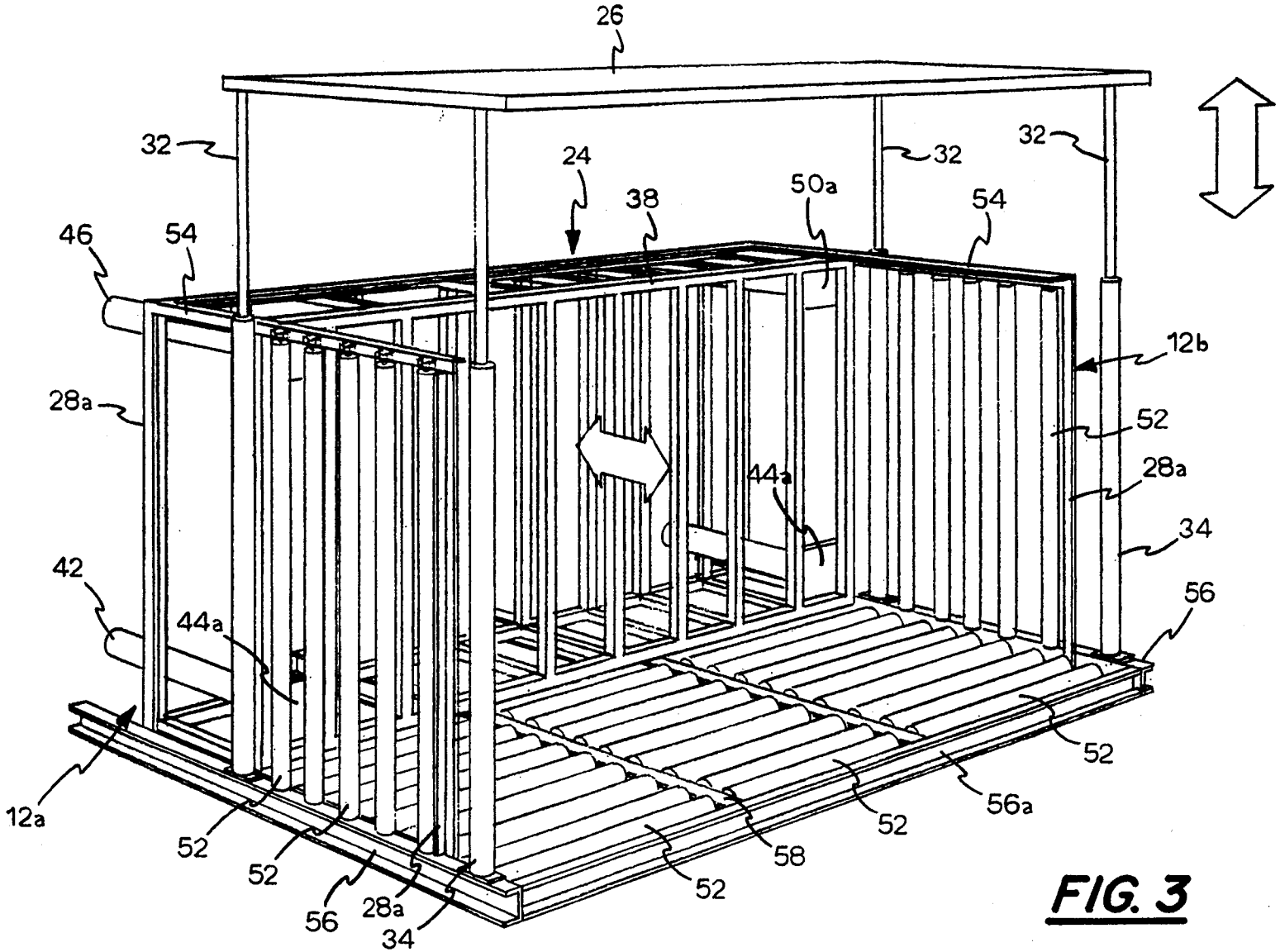
FIG. 3 is a perspective view of a modified self-contained structure or rack according to the invention.

In order to ease the stacked articles from the resultant U-shaped rack, provision can be made for friction reducing devices on loading platform 10, sidewalls 12a, 12b and/or cover member 26. A preferred friction reducing device or structure would include a plurality of elongated freely rotating cylinders or rollers 52 as shown in FIG. 3. Rollers 52 may be added to sides 12a, 12b around vertical sections mounted between vertical cylinders 34. In a preferred embodiment, a stationary main frame 54 is formed spanning front and rear upright sections 28a. Mainframe 54 may be constructed of angled beams so that a track is formed for moving vertical wall 24 from rear portion 10a to front portion 10b of loading platform 10.

Further, loading platform 10 can be constructed of a plurality of freely rotating rollers arranged in a line and side by side. In this embodiment, loading frame 10 may be constructed of "C" beams 56 forming a box-like structure. Cross bars 58 are positioned substantially perpendicular to a front C-beam 56a forming roller sections and a line of rollers 52 which are mounted around individual bars (not shown) for 360° rotation are rotatably secured in each section. Likewise, cover member 26 may have similar structure.

OPERATION

Figure 7:
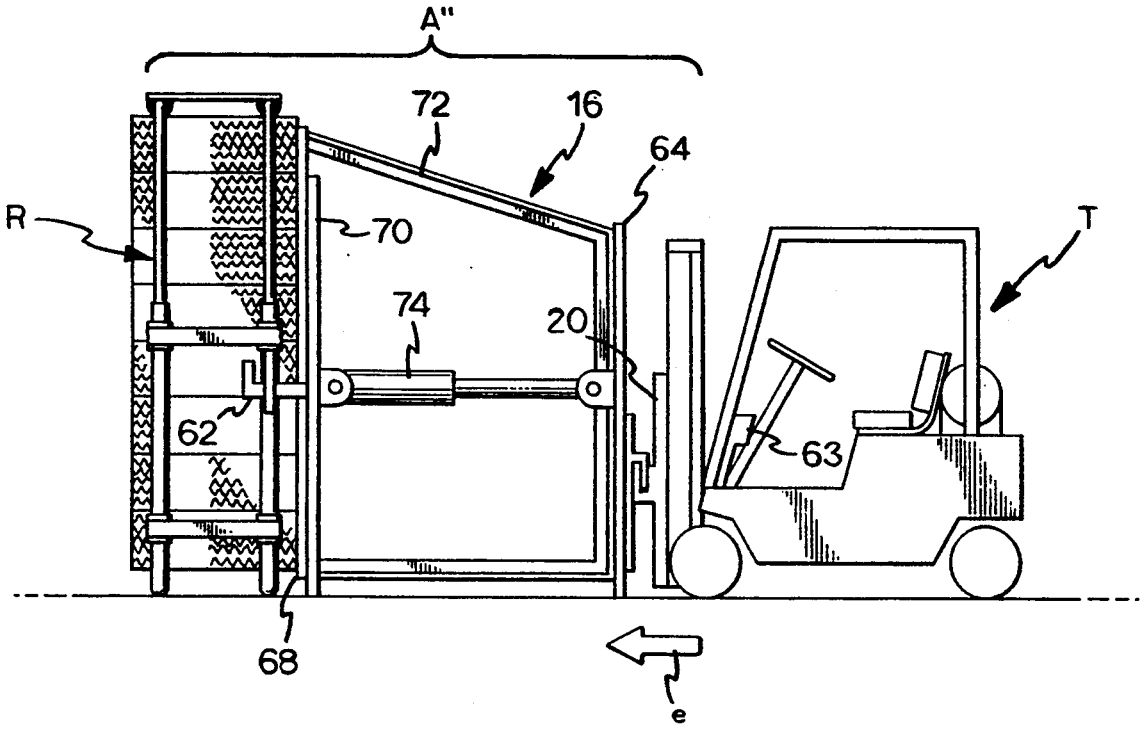
FIGS. 7 and 8 are side elevational views of yet another embodiment of the invention which employs a separate ramming unit, illustrating the hook-up and ejection operation of the separate ramming device.
Figure 8:
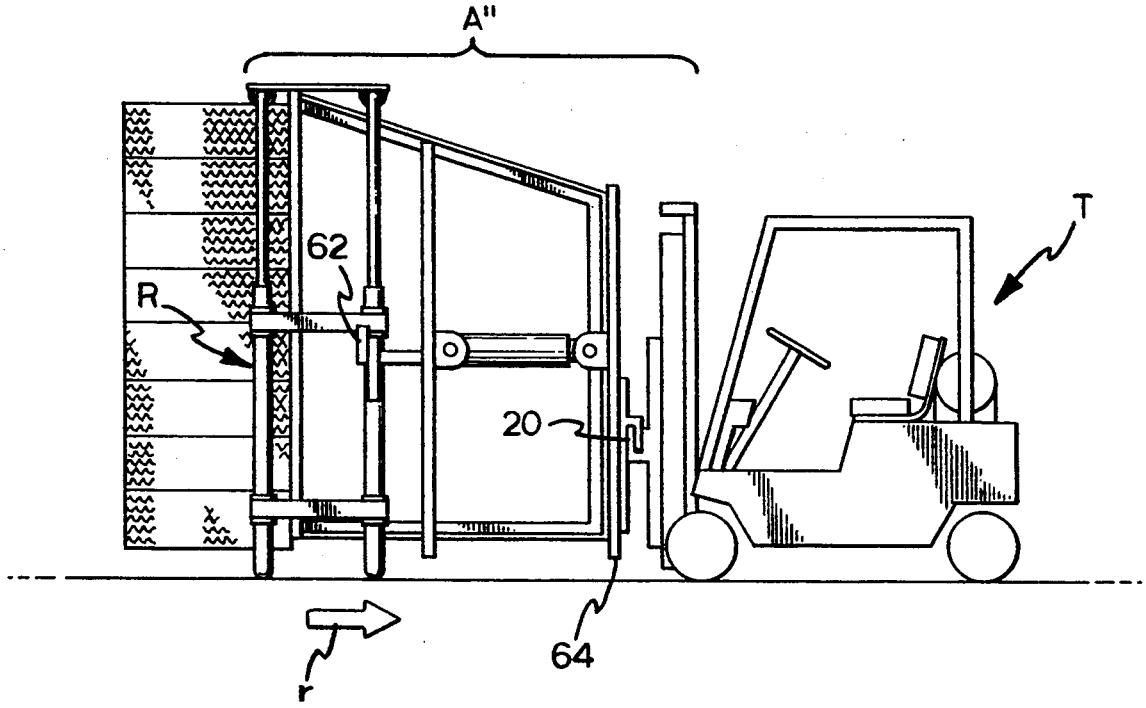

The operation of a article handling mechanisms according to the invention may be understood upon reference to FIGS. 4–6 which illustrate the self-contained embodiment operation and FIGS. 7 and 8 which depict the operation of a separate ram 16.

Initially, a standard warehouse truck T may be coupled to article handling mechanism A' via tines 22 sliding within a pair of shoes 60 attached to the bottom surface of loading platform 10 and to article handling mechanism A, A" (see FIGS. 7–8) via lugs 62 disposed on ram 16 and being inserted through handles 18 attached to the sides of frame sidewalls 12a, 12b (see FIG. 1).

As shown in FIG. 4, side legs 32 of cover member 26 and pistons 36 of vertical cylinders 34 can be designed so that cover member 26 can extend upwards to a maximum height of approximately 13 feet. After cover member 26 has been raised, workers can manually stack tires S or other articles onto loading platform 10. A self-contained unit may be designed with a variety of widths, but should be slightly less than that of the shipping container on which tires S are to be loaded. For example, such a unit may be approximately 93½ wide for loading an 8 foot wide shipping container. Thus, the number of stacked tires which would fit in a row across the shipping container can be compressed and loaded with an article handling mechanism according to the invention.

Once an extended self-contained unit is fully loaded with a row of stacked articles, vertical cylinders 34 can retract pulling cover member 26 downwardly (arrow d) thereby compressing tires S stacked within. If initially stacked 13 feet high, the stacked articles can be fully compressed down to approximately 94½ inches with an article handling mechanism A, A', A". Then, with the tines 22 of warehouse trucks T, self-contained handling mechanism A' and/or a rack R attached to handling mechanism A" can be moved from the tire stacking location into a shipping container having a ceiling C and a floor G. Horizontally disposed cylinders 42, 46 are activated pushing vertical wall 24 in a forward direction (arrow f) thereby pushing the row of stacked, compressed tires into place against a rear wall W of a shipping container (see FIG. 6). According to the invention, approximately 15% more tires can be loaded on a truck than with the device disclosed by Doster. Further, even though the compressed, stacked tires may initially expand between ceiling C and floor G of the shipping container, workers can still manually unpack tires loading in this manner due to the settling of the tires which occurs during transit.

The hydraulic or pneumatic operating systems connected to horizontal cylinders 42, 46 and vertical cylinders 34 can be connected to existing forklift controls 63 for operation of article handling mechanism A'. Moreover, the appropriate flow divider flows, pumps and motors the controlling hydraulic or pneumatic flow so that the horizontal cylinders, as well as the vertical cylinders work together to provide a smooth compression and ejection operations. One of ordinary skill in the art will recognize that conventional hydraulic or pneumatic systems can be employed.

SEPARATE RAM UNIT

Turning to FIGS. 1 and 7–8, a preferred structure of a ram 16 will now be described. A support attachment plate 64 having coupling members 66 is adapted for coupling to connection means 20 of a standard warehouse truck. Disposed substantially parallel to attachment plate 64 and spaced therefrom is a stationary wall 68 which can serve as a back wall to a rack formed by loading platform 10 and frame 12 when lugs 62, attached to respective sides of a movable support plate 70, are inserted through handles 18 of the rack. A substantially U-shaped member 72 may secure stationary wall 68, via welding or other conventional means, to attachment plate 64 as shown in the Figures.

As shown in FIGS. 7 and 8, ram 16 can be attached to a rack R in which a stack of tires are already compressed. Such a rack R is described and disclosed in applicant's co-pending application Ser. No. 07/831,923 filed Feb. 6, 1992, now U.S. Pat. No. 5,201,427. Alternatively, vertical cylinder and piston arrangements 69 can be mounted on respective sides of movable wall 70 to movably secure an angle shaped cover or horizontal member 14 above articles stacked within frame 12 when ram 16 is attached to frame 12 (see FIG. 1). Such an adjustable cover or horizontal member 14 can compress articles stacked therein.

Movable support plate 70 is preferably mounted via a conventional cylinder and piston arrangement 74 to support attachment plate 64 for horizontal movement. A plurality of such cylinder and piston arrangements can be employed to distribute ramming forces equally throughout movable wall 70. Cylinder and piston arrangement 74 is fully extended so that movable wall 70 rests against stationary wall 68 when ram 16 is attached to a rack holding stacked articles which are to be displaced via the ram (See arrow e of FIG. 7).

As shown in FIG. 8, the piston of cylinder and piston arrangement 74 is retracted, pulling movable wall 70 and rack R in a direction (arrow r) F toward support attachment 64. Since stationary wall 68 is fixed in its initial position, the stacked tires are pushed from rack R in their compressed, stacked formation. As in the above-described embodiment (FIGS. 2–6), the hydraulic or pneumatic operating systems connected to cylinder and piston arrangements 69, 74 can be connected to existing forklift controls 63 to operating the article handling mechanism.

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

I claim:

1. An article handling mechanism for attachment to warehouse trucks, said article handling mechanism comprising:

a) an article loading platform;

b) a frame secured to said article loading platform, said frame defining a rack, and said frame having a front and a rear and including a pair of sides;

c) each side being a vertical side extending substantially perpendicular to said article loading platform, and each side having a length sufficiently long to retain a plurality of articles stacked up on said article loading platform;

d) a generally horizontal member movably mounted for vertical movement with respect to said sides and with respect to said article loading platform;

e) said horizontal member being movable toward said article loading platform to a lowered position to compress articles loaded on said platform and away from said platform to a raised position to increase the loading area of said rack;

f) said vertical sides extending a substantial portion of the distance from said article loading platform to said generally horizontal member when said horizontal member is in its raised position away from said platform; and g) a horizontally movable ram movable in said frame from said rear to said front for ejecting articles under compression in said frame.

2. An article handling mechanism according to claim 1, wherein:

a) said horizontally movable ram includes an attachable member for being connected with said vertical sides of said frame.

3. An article handling mechanism according to claim 1, further comprising:

a) means for vertically moving said generally horizontal member toward and away from said loading platform.

4. An article handling mechanism according to claim 3 wherein said vertical moving means comprises:

a) a cylinder and piston assembly.

5. An article handling mechanism according to claim 3, wherein said horizontally movable ram comprises:

a) a support;

b) a movable vertical wall forming a rear wall of said frame when articles positioned on to said loading platform are being compressed; and c) a cylinder and piston assembly extending between said vertical wall and said support for causing said vertical wall to move relative to said pair of sides.

6. An article handling mechanism according to claim 1, further comprising:

a) means for reducing friction during ejection of the compressed articles from said frame.

7. An article handling mechanism according to claim 6, wherein:

a) said friction reducing means are disposed on said loading platform.

8. An article handling mechanism according to claim 7, wherein:

a) said friction reducing means are installed on said pair of sides.

9. An article handling mechanism according to claim 1, further comprising:

a) a plurality of rollers disposed on said loading platform for reducing friction when ejecting compressed articles from said frame.

10. An article handling mechanism according to claim 1, further comprising:

a) a plurality of rollers disposed on at least one side of said pair of sides for reducing friction when ejecting compressed articles from said frame.

11. A rack for packing and shipping articles, said rack being adapted for attachment to a warehouse truck and comprising:

a) a U-shaped loading frame for stacking articles therein, said loading frame including a loading platform on which articles are stacked, and a pair of sidewalls, each extending vertically from a respective opposite side of said loading platform to form the U-shaped frame;

b) a plurality of spaced-apart upright sections associated with said U-shaped loading frame;

c) a cover section having a plurality of spaced-apart side legs in slidable communication with respective upright sections of said U-shaped loading frame;

d) means for automatically moving and locking said slidable side legs and upright sections together to vertically compress articles stacked within said rack;

e) ramming means for pushing the compressed, stacked articles off said loading frame, said ramming means including a vertical wall movably disposed between said pair of frame sidewalls for movement in the horizontal direction;

f) said loading frame further including a support bar mounted across said pair of frame sidewalls behind said vertical wall; and g) said ramming mean further including:

i) a pair of cylinders mounted on said loading platform, the pistons of which being coupled to a respective side of the vertical wall bottom; and ii) a pair of cylinders mounted to said support bar, the pistons of which being coupled to the top of said vertical wall.

12. A rack according to claim 11, wherein:

a) said ramming means further includes a cylinder and piston arrangement which when activated causes said vertical wall to move across said loading platform in the horizontal direction.

13. A rack according to claim 12, wherein:

a) said automatic moving and locking means includes a cylinder and piston arrangement disposed on respective sides of said loading platform.

14. A rack according to claim 13, wherein:

a) a plurality of cylinder and piston arrangements are mounted on respective sides of said loading platform; and b) said side legs of said cover section correspond to pistons of said cylinder and piston arrangements and said respective upright sections correspond to associated cylinders of said cylinder and piston arrangements.

15. A rack according to claim 14, wherein:

a) a plurality of spaced-apart upright sections are disposed between said cylinders of said cylinder and piston arrangements mounted on respective sides of said loading platform; and b) elongated cylindrical rollers are rotatably disposed about said spaced-apart upright sections.

16. A rack for pacing and shipping articles, said rack being adapted for attachment to a warehouse truck and comprising:

a) a U-shaped loading frame for stacking articles therein, said loading frame including a loading platform on which articles are stacked, and a pair of sidewalls, each extending vertically from a respective, opposite side of said loading platform to form the U-shaped frame;

b) a plurality of spaced-apart upright sections associated with said U-shaped loading frame;

c) a cover section having a plurality of spaced-apart side legs in slidable communication with respective upright sections of said U-shaped loading frame;

d) an element for automatically moving and locking said slidable side legs and upright sections together to vertically compress articles stacked within said rack;

e) a ram for pushing the compressed, stacked articles off said loading frame, said ram including a vertical wall movably disposed between said pair of frame sidewalls for movement in the horizontal direction;

f) said loading frame further including a support bar mounted across said pair of frame sidewalls behind said vertical wall; and g) said ram further including:

i) a pair of cylinders mounted on said loading platform, the pistons of which being coupled to a respective side of the vertical wall bottom; and ii) a pair of cylinders mounted to said support bar, the pistons of which being coupled to the top of said vertical wall.

17. A rack according to claim 16, wherein:

a) said ram further includes a cylinder and piston arrangement which when activated causes said vertical wall to move across said loading platform in the horizontal direction.

* * * * *